United States Patent [19]

Smith

[11] Patent Number: 4,527,536

[45] Date of Patent: Jul. 9, 1985

[54] BOW STRING RELEASE DEVICE

[76] Inventor: Ted Smith, P.O. Box 706, Sophia, W. Va. 25921

[21] Appl. No.: 442,170

[22] Filed: Nov. 16, 1982

[51] Int. Cl.[3] ..... F41B 5/00

[52] U.S. Cl. ..... 124/35 A

[58] Field of Search ..... 124/35 A, 24 R, 23 R, 124/41 A

[56] References Cited

U.S. PATENT DOCUMENTS

| | | | |
|---|---|---|---|
| 1,542,159 | 6/1925 | Maxwell | 124/35 A |
| 2,488,597 | 11/1949 | Konold | 124/35 A |
| 2,819,707 | 1/1958 | Kayfes et al. | 124/35 A |
| 3,898,974 | 8/1974 | Keck . | |
| 4,036,204 | 7/1977 | Scott . | |
| 4,041,926 | 8/1977 | Troncoso et al. | 124/35 A |
| 4,105,011 | 8/1978 | Chism . | |
| 4,160,437 | 7/1979 | Fletcher . | |
| 4,257,386 | 3/1981 | Gazzara | 124/35 A |

*Primary Examiner*—Richard J. Apley
*Assistant Examiner*—William R. Browne
*Attorney, Agent, or Firm*—Sandler & Greenblum

[57] ABSTRACT

A bow release including a handle rotatably connected to a head frame having a pair of jaws with an open position for releasing the bow string and a closed position for holding the bow string. A firing pin is movably attached to the handle and has a first position disengaged from the jaws and a second position engaging the jaws. A firing element is attached to the handle for moving the firing pin from its first to its second position so as to move the jaws from their closed to their open position.

13 Claims, 3 Drawing Figures

BOW STRING RELEASE DEVICE

BACKGROUND OF THE INVENTION

This invention relates to the field of archery equipment and, more particularly, to a bow release.

Although the bow and arrow is a fairly simple device that has been used for thousands of years, devices to hold and release the bow have been difficult to design.

Bow releases usually comprise a bow string holding means, a trigger to open the bow string holding means and a handle. To use a bow release, the arrow is attached to the bow string, the bow release is then attached to the bow string, the bow release is pulled back away from the bow thereby also pulling the bow string away from the bow. The bow is aimed, the trigger of the bow release is pressed, thereby releasing the bow string from the bow string holding means and firing the arrow. The large force produced when the bow string is pulled back away from the bow drives the arrow forward.

Unfortunately, this large force has adverse side effects on the components of the bow release. First, this large force that is exerted by the bow string on the bow string holding means causes undue wear on the bow string. Second, the trigger may become maladjusted because the large force on the bow string holding means invariably is communicated to the trigger and affects its adjustment. Third, when one moves the handle to find the most comfortable position, the large force on the bow string may cause the string to twist or bind. Fourth, the large force of the bow string can cause the bow string holding means to open prematurely, especially when bows of different draw weights are used.

Thus, there is a need for a bow release that minimizes the wear on the bow string and trigger, that does not bind or twist the bow string when positioning one's hand on the handle of the bow release, that has a trigger that can stay precisely adjusted for repeated uses of the bow release, that will not open prematurely, and that can be used with bows of different draw weights.

SUMMARY OF THE INVENTION

It is an object of the present invention to solve the problems of the prior art.

It is a further object of the present invention to provide a bow release that minimizes the wear on the bow string and trigger.

It is still another object of the present invention to provide a bow release that does not bind or twist the bow string when positioning one's hand on the bow release.

It is a further object of the present invention to provide a bow release with a trigger that can stay precisely adjusted for repeated uses of the bow release.

It is another object of the present invention to provide a bow release that will not open prematurely and can be used with bows of different draw weights.

The foregoing and other objects of the present invention are achieved by a bow release having a handle, a head frame attached to the handle for releasably holding the bow string, a firing pin movably attached to the handle for opening the head frame, and a firing means for actuating the firing pin. The head frame comprises a frame and a pair of jaws attached thereto for holding the bow string. The jaws, and therefore the head frame, have an open position for releasing the bow string, and a closed position for holding the bow string therein.

The firing pin has a first position disengaged from the head frame and jaws and a second position in which the firing pin engages the head frame and jaws. The firing means moves the firing pin from the first position to the second position to move the head frame and jaws from their closed position to their open position. Other objects, advantages and novel features of the present invention will become apparent from the following detailed description of the invention in conjunction with the accompanying drawings.

DETAILED DESCRIPTION OF THE PREFERRED EMBODIMENTS

Figure 1:
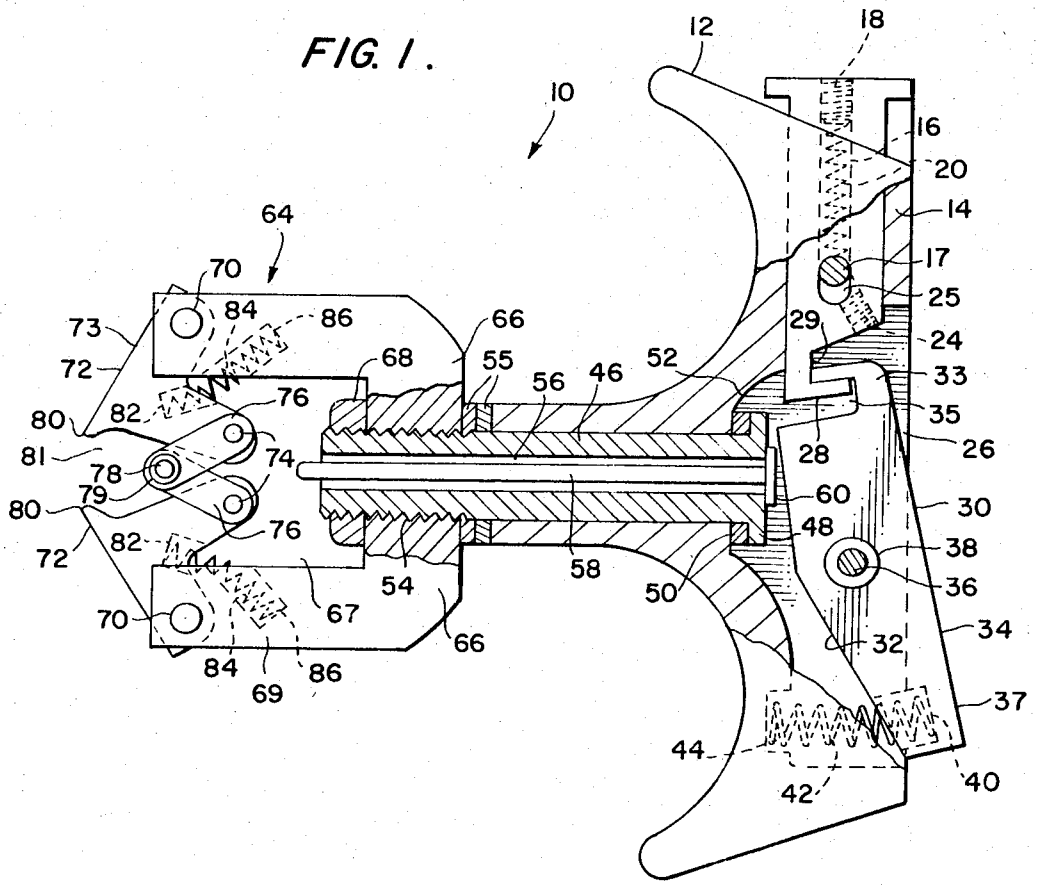
FIG. 1 is a side view of the bow release, partially cutaway, after the bow string is released.
Figure 2:
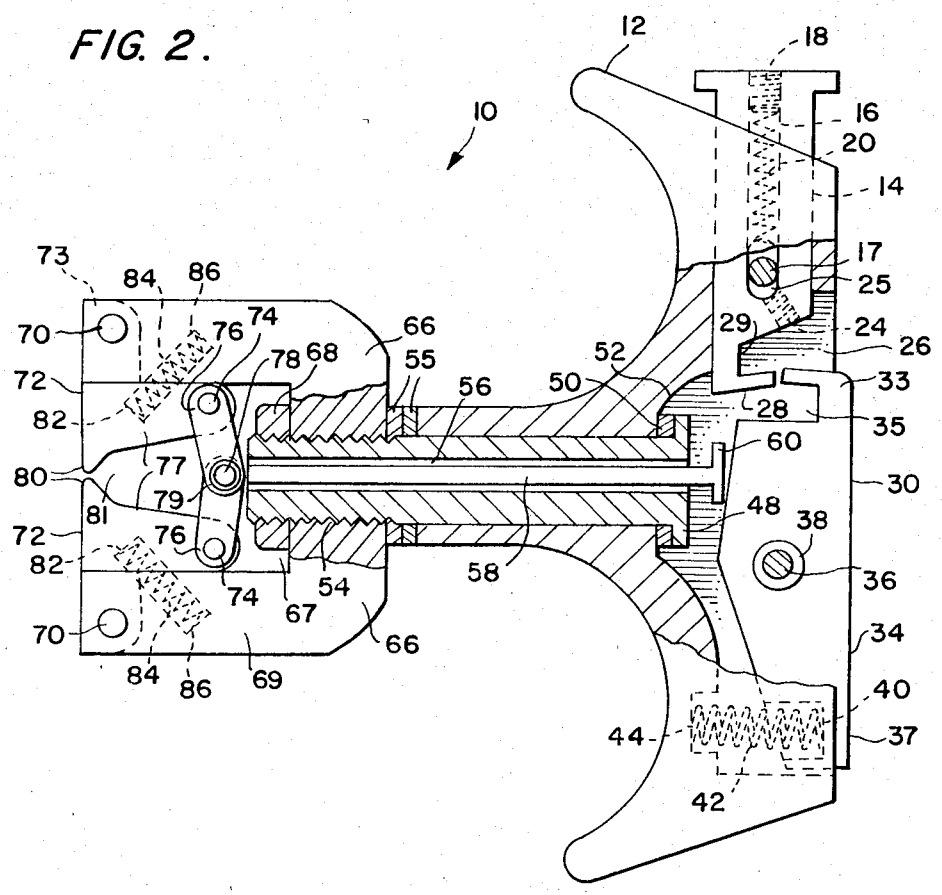
FIG. 2 is a partially cutaway side view of the bow release when the bow string is held in the release.
Figure 3:
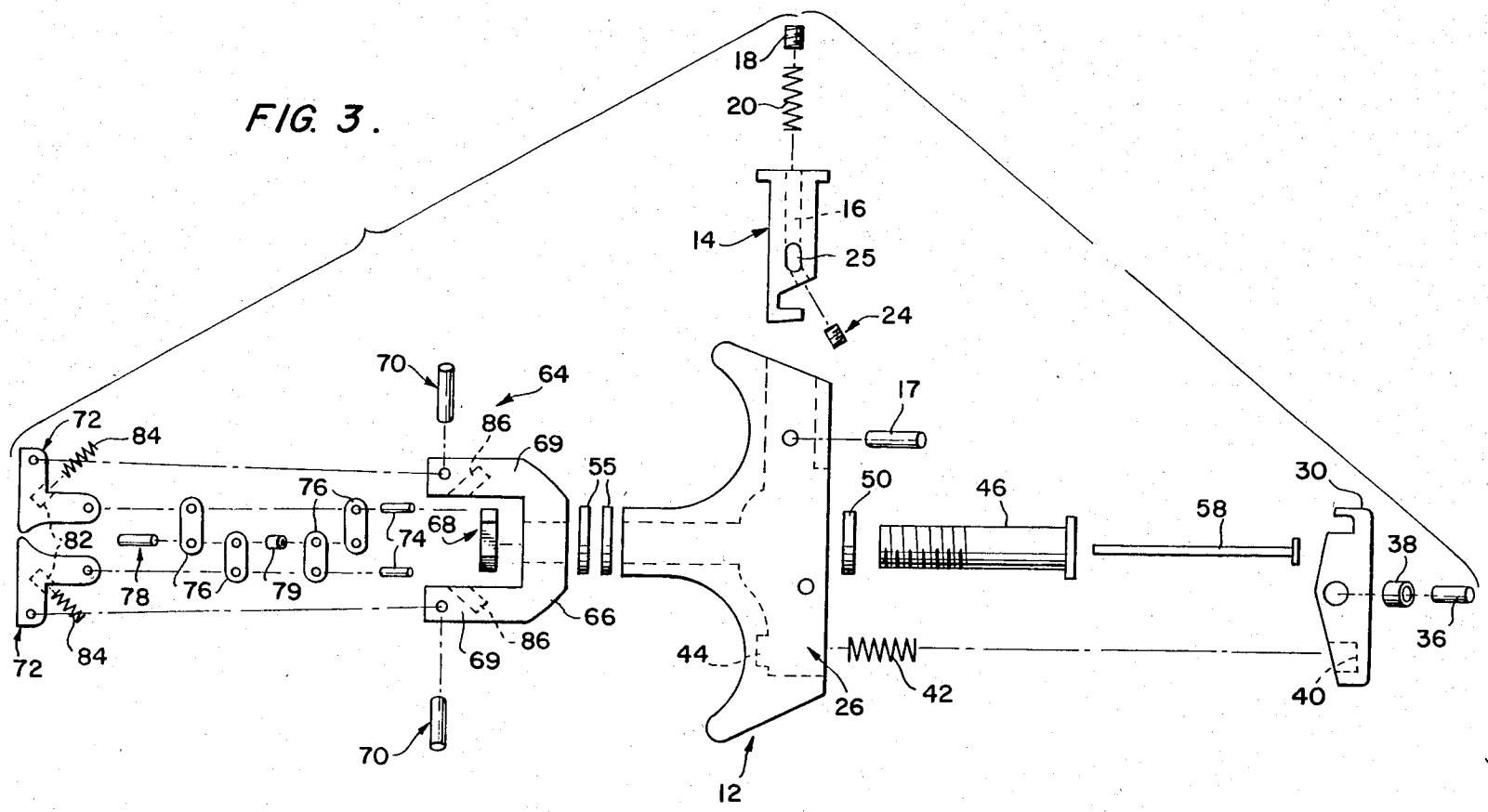
FIG. 3 is an exploded side view of the release.

The bow release of the present invention, generally designated as 10, as seen in FIGS. 1 and 2 and 3, comprises two pieces—a handle portion 12, and a head frame 64.

The handle 12 includes a moving or firing means, composed of a trigger 14 and a hammer 30. The handle 12 has several openings therein for receiving these components. One opening in the top of the handle 12 receives the trigger 14 which moves vertically therein. The trigger 14 also has an opening 16 therein which extends from the top to the bottom of the trigger, along the longitudinal axis thereof. The opening 16 is made of four different sections. The sections at the top and bottom of the trigger 14 are threaded, for receiving a mating threaded trigger spring adjustment screw 18 and a mating thread trigger movement adjustment screw 24, respectively, whose function will be described hereinbelow. Beneath the top threaded section is an unthreaded section 16 for housing the trigger spring 20. Spring 20 is a compression spring which biases the trigger upward as will be described hereinbelow. Between section 16 housing the trigger spring 20 and the section at the bottom that houses the screw 24, is oblong section 25, of greater length than a holding pin 17 that is received therein. Pin 17 holds the trigger 14 in the handle 12. After the pin 17 is placed through the trigger 14 in opening 25, the trigger may move vertically, to the extent allowed by the pin 17 as will be further described hereinbelow. The trigger also has a bottom portion or surface 28 which is L-shaped, having a protrusion defined by the horizontal portion of the L and a notch 29 for engaging hammer 30 as will also be described hereinbelow.

The sensitivity of the trigger can be controlled in two ways. First, the distance the trigger is permitted to travel can be controlled by the screw 24. Screw 24 extends into opening 25 to act as a stop and define the travel of 17 in the oblong opening 25. When the screw 24 is unscrewed it allows for more movement of the trigger 14 because the opening 25 is made larger and the trigger may be moved a greater distance before being stopped by pin 17. Conversely, when screw 24 is extended a large distance into opening 25, the trigger can only be moved a short distance before being stopped by pin 17.

Second, the amount of pressure needed for activating the trigger is controlled by the spring 20 and screw 18.

The further down the screw 18 is displaced, the tighter the spring 20 is compressed, and the more pressure the spring exerts to push the trigger upward. Thus, more pressure is needed to overcome the spring pressure to move the trigger 14 downward.

The second component of the firing means is the hammer 30. Hammer 30 has a forward face 32 which faces the head frame, and a rear face 34, and an upper inverted, backwards L-shaped portion 33 having a protrusion formed by the horizontal portion of the L and a notch 35. The hammer 30 is received in opening 26 in handle 12, and is pivotally held on handle 12 by pin 36 and bushing 38 which go through hammer 30 and handle 12.

The hammer 30 also has an indentation 40 in the inside of the bottom of its forward face 32 for receiving a hammer spring 42. The other end of the spring 42 is received in an indentation 44 in handle 12. The spring 42 biases the hammer 30 to pivot counterclockwise around pin 36 whose significance will be explained below.

The operation of the hammer and trigger will now be described. The spring 20 in the trigger 14 forces the trigger upward. The lenghts of the oblong opening 25, the bottom 28 of the trigger and the top 33 of the hammer are so chosen that when the trigger is in its highest vertical position as allowed by pin 17 and seen in FIG. 2, the horizontal protrusion of the bottom 28 of the trigger 14 abuts the horizontal protrusion of the top 33 of the hammer, preventing the hammer top 33 from pivoting forward as it is urged to do so by spring 42.

When the trigger 14 is pressed down, as seen in FIG. 1, the trigger spring 20 is compressed and the trigger bottom 28 is moved below hammer top 33. Since trigger bottom 28 no longer constrains hammer top 33, hammer top 33 is pivoted forward by hammer spring 42 into the notch 29 of trigger 14. simultaneously, trigger bottom 28 is moved into notch 35 of hammer 30. Notch 35 constrains trigger bottom 28 from moving upward, as it is urged to do by trigger spring 20. When hammer 30 pivots forward head frame 64, the front face 32 of hammer 30 also pivots toward the head frame 64 knocking a firing pin 58 into links 76 to open jaws 72 as will be described below.

To restore the trigger 14 and hammer 30 to their previous positions, hammer 30 is pushed forward at 37, thereby compressing spring 42 and pivoting hammer 30 clockwise. This action removes hammer top 33 from notch 29 of the trigger, and simultaneously removes trigger bottom 28 from notch 35 in hammer 30. Since notch 35 no longer constrains trigger 14, spring 20 moves trigger 14 upward until trigger bottom 28 again abuts against hammer top 33.

The handle 12 also has another opening therein which extends horizontally from the opening 26 to the opposite end of the handle 12. A swivel bolt 46 is received in this opening and moves freely therein. Swivel bolt 46 has a flange 48 at one end thereof that has a larger diameter than the opening in which the swivel bolt 46 is received for preventing the swivel bolt from being pulled out of the handle 12. A washer 50, which may be made of Teflon, is disposed between the flange 48 of the swivel bolt and the back wall 52 of the handle 12, so that the flange 48 abuts against the washer 50 which acts as a bearing. The other end of the swivel bolt 46 is threaded at 54 and is received on a correspondingly threaded opening in the back wall 66 of head frame 64. The threaded portion 54 of the swivel bolt 46 is longer than the threaded opening in the back wall 66 of the head frame 64 so that when the swivel bolt 46 is fully threaded into the head frame 64, the threaded portion 54 extends beyond the back wall 66 in the head frame 64. A nut 68 is threaded over this threaded portion 54 that extends beyond the back wall 66 in the head frame 64, to securely fasten the swivel bolt 46 to the head frame 64.

When the handle 12 is connected to the head frame 64 by swivel bolt 46, the handle 12 may be freely rotated with respect to head frame 64 because the swivel bolt 46 moves freely with respect to the handle 12. Shim washers 55 can be placed between the handle 12 and the head frame 64 to insure a tight fit therebetween by holding the handle against washer 50.

The swivel bolt 46 also has an opening 56 therein that extends the full length thereof. This opening 56 receives a firing pin 58 which moves freely therein. Firing pin 58 has flange 60 at one end thereof, which is of a larger diameter than opening 56. Because the flange 60 has a larger diameter than the opening 56, the flange 60 cannot enter the opening 56 and, therefore, limits the forward movement of the firing pin in opening 56. Also note that the firing pin 58 is longer than the swivel bolt 46 so that it extends beyond the swivel bolt 46 into the cavity 67 of the head frame 64 for striking bushing 79 of jaw links 76 forward to open the jaws 72 as will be explained below.

The head frame 64 is U-shaped, having a back wall 66 connecting two legs 69. The two legs 69 each have an opening therein for receiving a pin 70, which pivotally connects a jaw 72 to the frame 64. Jaws 72 are roughly L-shaped. On one leg 73 of the L of each jaw 72 has an opening for receiving the pin 70, so that a jaw 72 pivots about pin 70. The other leg 77 of each jaw 72 also has an opening for receiving a pin 74, which pivotally connects each jaw 72 to one end of a pair of jaw links 76. The other end of the pair of jaw links 76 contains an opening for receiving a pin 78 and bushing 79 which pivotally connects to the other set of jaw links 76. Thus, the jaws 72 may pivot between an open position, seen in FIG. 1, when the jaw links 76 are in an inverted V position when viewed from the handle 12, and a closed position, as seen in FIG. 2, where the jaw links 76 are in a V position when viewed from the handle 12. In the closed position the jaw links 76 are tilted back toward the handle 12 and the apex of the V at pin 78 is to the right of the longitudinal axis connecting pins 74. The links 76 are prevented from travelling toward the handle any further by the swivel bolt 46 which may be adjusted by loosening nut 68.

The jaws 72 also have an elongated tip 80 that forms the front wall of a cavity 81 for receiving a bow string, when the jaws are closed, as seen in FIG. 2. When the jaws 72 are in their closed position, the tip 80 of each jaw 72 abuts against the tip of the other jaw 72, thereby being capable of holding a bow string inside said jaw cavity 81.

Each jaw 72 has one additional feature of importance. At the point where the horizontal and vertical legs 73 and 77 of each jaw 72 meet, an opening 82 is formed, for receiving one end of a spring 84. The other end of the spring 84 is received in an opening 86 in each leg 69 of the head frame 64. The spring 84 produces a biasing force to toggle the jaws 72 to their open position when the apex of the V at pin 78 moves to the left of the longitudinal axis connecting pins 74. In addition, when the jaws are in their open position, as in FIG. 1, springs 84 bias the jaws 72 to stay in their open position. This bias is strong enough to prevent the jaws from closing accidentally, but weak enough to allow the jaws to close when a concerted effort is made. The preferred method of closing the jaws is to apply pressure with the bow string on the apex of the V in the links 76 at the bushing 79 back towards the handle, thereby causing the front legs 73 of the jaws 72 to pivot together so apexes 80 touch each other.

When the jaws 72 are closed and the apex of the V formed by jaw links 76 are to the right of the longitudinal axis connecting pins 74, spring 84 bias the jaws to stay closed. The bias is strong enough to prevent the jaws from becoming opened accidentally, but weak enough to allow the jaws to open when the firing pin 58 contacts the apex of the V of the jaw links 76 as will be described hereinbelow.

To operate the bow release, place the handle 12 between the index and middle finger of the hand with the hammer 30 turned toward the palm of the hand.

To clock the release 10, start with the release in its open position (FIG. 1); press the thumb down on the hammer at point 37. This causes hammer 30 to pivot around hammer pin 36, compressing hammer spring 42 and disengaging hammer top 33 from the notch 29 in trigger 14. The hammer 30 is now positioned as in FIG. 2. With the hammer top 33 disengaged from the trigger notch 29, trigger spring 20 pushes the trigger 14 upward and away from hammer 30. Trigger 14 stops moving when the adjustment screw 24 comes into contact with pin 17 as seen in FIG. 2. At this time thumb pressure can be released at 37 of hammer 30. The horizontal protrusion of the top portion 33 of the hammer 30 now abuts against the horizontal protrusion of the bottom portion 28 of the trigger 14. The horizontal protrusion of the bottom portion 28 of the trigger 14 prevents hammer top 33 from pivoting counterclockwise, as it is urged to do so by spring 42.

With the hammer 30 in this position as seen in FIG. 2, the flange 48 of the firing pin 58 floats freely between swivel bolt 46 and forward wall 32 of the hammer 30. The bow string is now ready to be attached. At this point, the hammer 30 and trigger 14 are in the positions shown in FIG. 2 and the jaws are open as seen in FIG. 1.

To connect the bow release 10 to a bow string (not shown), insert the bow string between the jaws 72 into cavity 81 and push the bow string against the jaw link bushing 79. When this is done, the jaw links 76 are pivoted backward from their inverted V position of FIG. 1 to their V position seen in FIG. 2, thereby closing the jaws 72. Jaw links 76 now come to rest against the swivel bolt 46. The swivel bolt 46 is preadjusted to allow the jaw links 76 to come to rest in a very shallow V configuration so that the apex of the V is to the right of the longitudinal axis connecting pins 74. The jaw springs 84 now bias the jaws 72 so as to push the jaw links 76 up against the swivel bolt 46 thereby locking the jaws 72 closed.

The bow release 10 is therefore locked onto the bow string. The bow string is now drawn away from the bow in preparation for firing the bow. As the bow string is pulled away from the bow, the bow string contacts the tip 80 of the jaws 72 and applied pressure thereon. This force on tip 80 forces the links 74 to abut up against the swivel bolt 46 with even more force, thereby locking the jaws 72 even tighter.

As the bow release 10 is positioned for shooting, handle 12 can be swiveled 360° (on washer 55) for the most comfortable position in one's hand without binding or twisting the bow string. When it is time to release the bow string, one presses down on trigger 14. This compresses spring 20 and moves the trigger bottom 28 down and out of contact with the horizontal protrusion of the hammer top 33. Spring 42 causes hammer 30, which can now move unimpeded, to move counterclockwise, driving its forward face 32 into the flange 60 of the firing pin 58. The firing pin 58 is driven forward and hits the jaw link bushing 79, pivoting the jaw links 76 forward, overcoming the bias of the springs 84. The jaw links 72 are then pushed open by the bow string pressure and the springs 84, which now bias the jaws 72 open. All these forces cause the jaw links 72 to open, releasing the bow string and firing the arrow.

The bow release 10 may be assembled as follows. First, the head frame 64 is assembled. The links 76 are connected to the jaws 72 by pins 74 and to each other by pin 78 and bushing 79. The springs 84 are then placed into position. Next, the jaws 72 are connected to the head frame legs 69 by pins 70.

Second, the handle 12 is connected to the head frame 64. Washer 50 is first placed against wall 52 of handle 12. Then swivel bolt 46 is inserted, thread end first, through opening 26 in handle 12. Next, the swivel bolt 46 is screwed into the head frame 64. Then nut 68 is screwed onto swivel bolt 46, to attach the handle 12 to the head frame 64. Any washers 55 that are needed are attached before the nut 68 is tightened. Now, the swivel bolt 46 is adjusted so that the jaw links 76 contact the swivel bolt 46 when the links 76 make a shallow V with the apex of the V at pin 78 to the right of the longitudinal axis connecting pins 74 to make the jaws close.

Next, the firing pin is inserted, flange section 60 last, into the opening 56 of the swivel bolt, through opening 26 in the handle 12. Then, the trigger 14 is inserted in the handle 12, and the pin 17 is placed through opening 25 to attach the trigger 14 to the handle 12. Next spring 20 is placed through opening 16 of the trigger 14 and screws 18 and 24 are screwed into the trigger 14. Then spring 42 is placed in indentation 44 of handle 12 and bushing 38 is placed into hammer 30.

Next, hammer 30 is placed into opening 26 of the handle 12 and is attached to handle 12 by pin 36. Thus, the bow release 10 is now assembled. Alternatively, the hammer 30 may be assembled before the trigger 14.

In the preferred embodiment, the jaws 72, jaw links 76, and pins 17, 36, 70, 74, 78 and bushing 38 are made of tempered steel; the firing pin 58, swivel bolt 46, nut 68 and shim washers 55 are made of iron; the head frame 14, handle 12, hammer 30, and trigger 14 are made of aluminum; and washer 50 is Teflon, although other materials may be used and the invention is not limited to the use of these materials.

It will be evident to those skilled in the art that this bow release 10 has a number of advantages. First, the jaws 72 and the trigger 14 are not rigidly coupled together. Therefore, all the pressure placed on the bow release by the bow string is confined to the jaws 72 and links 76. Thus, the greatest source of pressure on the bow release—pressure from the bow string—never communicates with the hammer 30 and trigger 14 and, consequently, there is very little wear on these parts. Only pressure from the hammer spring 42, which is small, causes wear between the trigger bottom 28 and hammer top 33. Furthermore, once the bow string is pulled back for shooting, all this bow string pressure is not coupled to the trigger and, consequently, the sensitive trigger can stay adjusted, ready to fire, for a long time and after repeated shootings, without interference from the bow string. Another advantage of uncoupling the jaws 72 from the trigger 14 is that the only jaw tension needed is that tension necessary to hold the jaws open or closed; additional tension to operate a trigger is not needed in the jaws. Consequently, only a small force is needed to close the jaws to attach the bow string to the jaws 72; no additional force is needed to move the trigger in closing the jaws. Because the jaws can be closed with so little force by pushing the bow string against the bushing 79, the release can be attached to the string in one easy motion.

Second, because the jaw links 76 hold the jaws 72 closed even tighter as more pressure is applied by the bow string, this bow release 10 can be used to shoot bows of vastly different draw weights.

Third, because the handle 12 is attached to the head frame 64 by a swivel bolt 46 and washer 55, the handle may be rotated 360° with respect to the head frame 64 and bow string, thereby allowing one to hold one's hand in any comfortable position after the bow is drawn, without binding or twisting the bow string.

Fourth, the handle 12 is designed so that the trigger 14 can be activated by the thumb or the ring finger. The trigger pressure is applied between the ring finger and thumb, thus minimizing any side motion when activating the trigger to release the bow string.

Fifth, the spring tension and trigger movement can be adjusted giving a wide range of trigger adjustments.

Sixth, because the jaws open from both sides, there is very little friction on the bow string as it leaves the jaws 72.

From the preceeding description of the preferred embodiment, it is evident that the objects of the invention are attained. Although the invention has been described in detail, it is clearly understood that the same is by way of illustration and example only, and is not to be taken by way of limitation. The spirit and scope of the invention is to be limited only by the terms of the appended claims.

What is claimed is:

1. A bow release comprising:

a handle;

a head frame means attached to said handle, for holding and releasing a bow string wherein said head frame means comprises means for permitting movement thereof between an open position for releasing a bow string and a closed position for holding a bow string therein;

a firing pin, said release further comprising means for permitting said firing pin to be movably attached to said handle, said release further comprising means for moving between said pin a first position disengaged from said head frame means and a second position engaging said head frame means; and said moving means, attached to said handle, for moving said firing pin from said first position to said second position to move said head frame means from said closed to said open position, wherein said moving means is spaced from said moving pin before said firing means moves said firing pin from said first position to said second position.

2. The bow release of claim 1 wherein said head frame means further includes a frame and a pair of jaws wherein said jaws comprise means for permitting said jaws to be movable with respect to said frame, wherein said jaws further comprising means for permitting movement thereof between an open position for releasing a bow string and a closed position for holding a bow string therein.

3. The bow release of claims 2 further comprising means for pivotally connecting said pair of jaws at one end thereof to said head frame means, and jaw links, wherein said pair of jaws further comprises means for pivotally connecting each jaw at its other end to one end of one of said jaw links each jaw link comprising means for pivotally connecting one of said jaw at its other end to said other jaw link, release links further comprises means for contacting said jaw links, thereby moving said jaws from said closed to said open position, when said firing pin is in its second position.

4. The bow release of claim 2, further including a biasing means, attached to said jaws and said frame, for biasing said jaws to open, when said jaws are in said open position, and biasing said jaws closed when said jaws are in said closed position.

5. The bow release of claim 1, further including connecting means to rotatingly connect said handle to said head frame means in such a manner that said handle may be freely rotated 360° with respect to said head fram means, wherein said connecting means is attached to said handle and said head frame means.

6. The bow release of claim 5 wherein said connecting means is a swivel bolt, rigidly attached at one end thereof to said head frame means and rotatingly attached at the other end thereof to said handle so that said handle may freely rotate 360° with respect to said swivel bolt and said head frame means, and wherein said swivel bolt has a longitudinal opening therein which receives said firing pin.

7. the bow release of claim 1 wherein said moving means further includes:

a vertically movable trigger attached to said handle, said release comprises means for permitting movement of said trigger between a first position and a second position; and a hammer attached to said handle, said hammer comprises a biasing means attached to said handle to bias said hammer toward said head frame means, wherein said hammer further comprises means for permitting movement of said hammer between a first position and a second position, said hammer comprises means for contacting said trigger, said hammer, when in the first position, being spaced from and biased toward said firing pin said hammer being movable from its first position to its second position, said hammer further comprises means for contacting said firing pin, and said hammer comprises means for moving said firing pin from its first position to its second position.

8. The bow release of claim 7, wherein said hammer is pivotally attached to said handle and further includes a top portion, said trigger further includes a bottom portion having a protrusion and a recess, wherein said top portion of said hammer contacts said protrusion of said trigger when said hammer and trigger are in their said first positions, and said top portion of said hammer contacts said recess of said trigger when said hammer and said trigger are in their said second positions.

9. The bow release of claim 7, wherein said trigger includes a movement adjustment means attached thereto for adjusting the distance said trigger moved between said first and second positions.

10. The bow release of claim 7, wherein said trigger further includes a biasing means therein, fur urging said trigger from said second to said first position and for urging said trigger to remain in said first position, wherein said hammer further comprises means for restraining said trigger from moving from said second to said first position of said trigger when said hammer is in said second position of said hammer.

11. The bow release of claim 10, wherein said trigger further includes a pressure adjusting means attached thereto for adjusting the pressure needed to move said trigger from said first to said second positions.

12. A bow release comprising:

a handle;

jaw links;

a head frame means attached to said handle, for holding and releasing a bow string, wherein said head frame means includes a frame and a pair of jaws, wherein said jaws comprise means for permitting said jaws to be movably attached to said frame, wherein said jaws further comprise means for permitting movable thereof between an open position for relasing a bow string and a closed position for holding a bow string therein, said pair of jaws further comprise means for pivotally connecting said pair of jaws at one end thereof, said pair of jaws further comprise means for pivotally connecting each jaw at its other end to one end of said jaw link, each jaw link comprising means for pivotally connecting the other end of said jaw link to said other jaw link;

a firing pin, said release further comprising means for permitting said firing pin to be movably attached to said handle said release further comprising means for moving said pin between a first position disengaged from said head frame means and a second position engaging said head frame means, said firing pin further comprises means for contacting said jaw links, thereby moving said jaws from said closed to said open position when said firing pin is in said second position; and said moving means, for moving said firing pin from said first position to said second position to move said jaws from said closed position to said open position, comprising means for attaching said moving means to said handle.

13. A bow release comprising:

a handle;

a head frame means attached to said handle, for holding and releasing a bow string, wherein said head frame means comprises means for moving between an open position for releasing a bow string and a closed position for holding a bow string therein;

a firing pin, said release comprising means for movably attaching said firing pin to said handle, and wherein said release further comprises means for permitting movement of said firing pin between a first position disengaged from said head frame means and a second position engaging said head frame means;

a moving means, for moving said firing pin from said first position to said second position to move said head frame means from said closed position to said open position wherein said moving means further comprises means for attaching said moving means to said handle; and a connecting means for rotatably connecting said handle to said head frame means in such a manner that said handle may freely rotated 360° with respect to said head frame means, wherein said connecting means is attached to said handle and said head frame means, and wherein said connecting means is a swivel bolt, rigidly attached at one end thereof to said head frame means and rotatably attached at the other end thereof to said handle so that said handle may freely rotate 360° with respect to said swivel bolt and said head frame means, and wherein said swivel bolt has a longitudinal opening therein which receives said firing pin.

* * * * *

UNITED STATES PATENT AND TRADEMARK OFFICE

CERTIFICATE OF CORRECTION

PATENT NO. : 4,527,536

DATED : July 9, 1985

INVENTOR(S) : Ted Smith

It is certified that error appears in the above-identified patent and that said Letters Patent is hereby corrected as shown below:

Column 3, line 23, change "lenghts" to ---lengths---.

Column 3, line 36, change "simultaneously" to ---Simultaneously---.

Column 5, line 20, change "clock" to ---lock---.

Column 7, line 54, delete "between".

Column 7, line 54, after "pin" add ---between---.

Column 7, line 61, change "moving", second occurence, to ---firing---.

Column 7, line 62, delete "firing", first occurence.

Column 8, line 9, after "links", add ---,---.

Column 8, line 10, after "jaw", add ---links---.

Column 8, line 11, after "link," add ---said---.

Column 8, line 24, change "fram" to ---frame---.

Column 8, line 34, change "the" to ---The---.

Column 8, line 48, after "pin" add ---,---.

Column 8, line 65, change "moved" to ---moves---.

Column 8, line 68, change "fur" to ---for---.

Column 9, line 20, change "movable" to ---movement---.

UNITED STATES PATENT AND TRADEMARK OFFICE

CERTIFICATE OF CORRECTION

PATENT NO. : 4,527,536

DATED : July 9, 1985

INVENTOR(S) : Ted Smith

It is certified that error appears in the above-identified patent and that said Letters Patent is hereby corrected as shown below:

Column 9, line 21, change "relasing" to ---releasing---.

Column 9, line 32, after "handle" add ---,---.

Column 6, line 51, delete "14".

Column 6, line 50, after "headframe" add ---64---.

Column 7, line 59, after "position", add ---,---.

Column 8, line 4, change "claims" to ---claim---.

Column 10, line 28, change "rotated" to ---rotate---.

Signed and Sealed this

*Eleventh* Day of *February 1986*

[SEAL]

*Attest:*

DONALD J. QUIGG

*Attesting Officer*

*Commissioner of Patents and Trademarks*